United States Patent [19]

Szuba

[11] Patent Number: 5,039,914

[45] Date of Patent: Aug. 13, 1991

[54] DIMMER CONTROL CIRCUIT

[75] Inventor: Stefan F. Szuba, Park Ridge, Ill.

[73] Assignee: North American Philips Corporation, New York, N.Y.

[21] Appl. No.: 403,222

[22] Filed: Sep. 5, 1989

[51] Int. Cl.[5] ..... H05B 37/02

[52] U.S. Cl. ..... 315/158; 315/159; 315/307; 315/DIG. 4

[58] Field of Search ..... 315/158, 307, 151, 156, 315/DIG. 4

[56] References Cited

U.S. PATENT DOCUMENTS

| | | | |
|---|---|---|---|
| 3,681,654 | 8/1972 | Quinn | 315/151 |
| 4,135,116 | 1/1979 | Smith | 315/158 |
| 4,254,364 | 3/1981 | Flint et al. | 315/311 |
| 4,874,989 | 10/1989 | Nilssen | 315/158 |

FOREIGN PATENT DOCUMENTS

| | | |
|---|---|---|
| 3706229 | 3/1988 | Fed. Rep. of Germany . |
| 1411198 | 2/1989 | Japan . |
| 1187797 | 7/1989 | Japan . |
| 2213983 | 8/1989 | United Kingdom . |
| 2214289 | 8/1989 | United Kingdom . |
| 2220478 | 1/1990 | United Kingdom . |

*Primary Examiner*—Eugene R. LaRoche
*Assistant Examiner*—Son Dinh
*Attorney, Agent, or Firm*—Robert T. Mayer

[57] ABSTRACT

A control circuit for a dimmer which receives all of its operating power through the control terminals from the dimmer of the fluorescent lamp to which said dimmer is connected.

5 Claims, 1 Drawing Sheet

DIMMER CONTROL CIRCUIT

This is an invention in the lighting art. More particularly, it is an invention in controlling the light output of fluorescent lamps.

This invention is related to that disclosed in application Ser. No. 358,257 (now U.S. Pat. No. 5,003,230 issued Mar. 26, 1991) of John M. Wong and Michael A. Kurzak filed May 26, 1989 under the title "Fluorescent Lamp Controllers With Dimming Control" and assigned to the same assignee as this application now U.S. Pat. No. 5,003,230 issued Mar. 26, 1991. Application Ser. No. 358,257 and all matter incorporated by reference therein is hereby incorporated by reference herein.

It is an object of this invention to provide a more simplified control circuit for dimming controllers for fluorescent lamps.

One of the advantages of the invention is that an auxiliary power supply which formerly was provided with dimming control circuits is not required with the control circuit of this invention.

One of the features of the invention is that the disclosed dimming control circuit requires less wiring than former dimming control circuits.

In carrying out the invention there is provided a control circuit for a fluorescent lamp dimmer which is connected to the ballast for a fluorescent lamp. The dimmer has two control terminals. The control circuit includes a light sensor which produces an output signal representative of ambient light. The light sensor is connected to a first amplifier which amplifies an output signal of the light sensor. The first amplifier has an output. A second amplifier is connected to the output of the first amplifier. The second amplifier operates to regulate the output signal of the first amplifier. The second amplifier has an output which is connected to a third stage which acts as a current sink. The output of the second amplifier is connected to the third stage which is connected across the two control terminals of the dimmer. The difference between the disclosed invention and prior art control circuits is that the control circuit of the invention receives power for its operating cycle through the control terminals of the dimmer.

Figure 1:
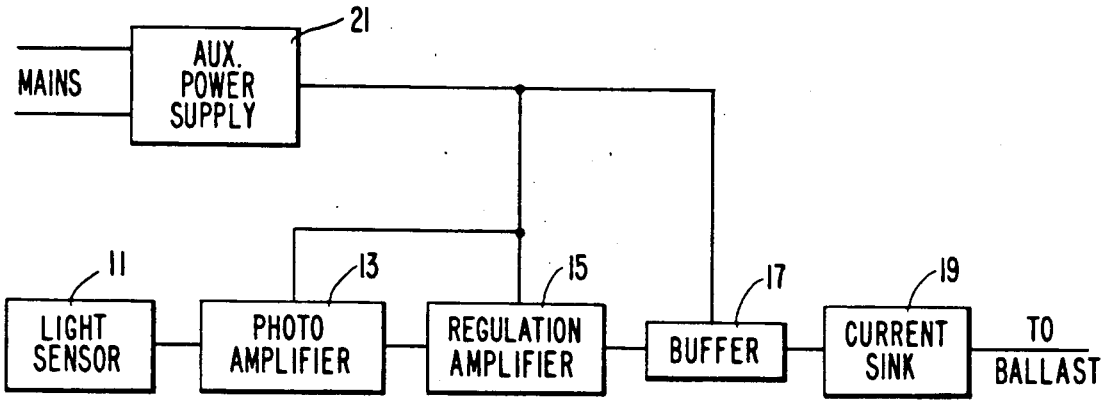
Figure 2:
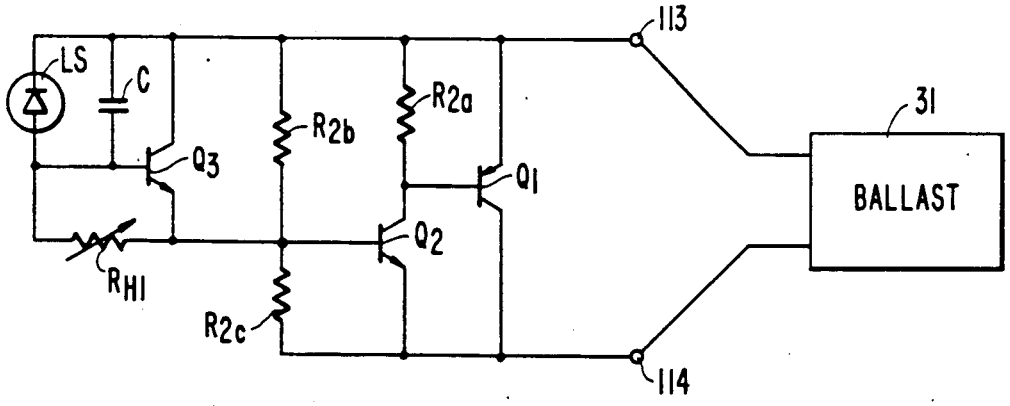

Other objects, features and advantages of the invention will be apparent from the following description and appended claims when considered in conjunction with the accompanying drawing in which, FIG. 1 is a block diagram of a dimmer control circuit provided in accordance with former designs; and FIG. 2 is a dimmer control circuit provided in accordance with this invention.

As can be seen from FIG. 1, in the past there was provided light sensor 11 whose output is provided to a photo-amplifier for amplification of the signal generated by light sensor 11. Photo-amplifier 13 is connected to regulation amplifier 15. Regulation amplifier 15 produces an output which causes the dimmer control circuit to affect the fluorescent lamps to which :t is connected to operate as desired. Regulation amplifier 15 is connected to buffer 17 which acts to render the signals from amplifier 15 suitable for transmission current sink 19. Buffer 17 is itself connected to current sink 19 which is connected to the fluorescent lamp ballast such as that disclosed in application Ser. No. 358,257.

As can be seen from FIG. 1, photo-amplifier 13, regulation amplifier 15, and buffer 17 are all connected to auxiliary power supply 21 which in turn is connected to the power mains.

The invention is shown in FIG. 2 of the drawing wherein it is shown that the control circuit is connected to terminals 113 and 114 of FIG. 1 of application Ser. No. 358,257. As can be seen in FIG. 2 there is provided a light sensor LS which senses ambient light. Light sensor LS is connected across capacitor C one end of which is connected to the base of NPN transistor $Q_3$. The other end of capacitor C is connected to the collector of transistor $Q_3$.

The emitter of transistor $Q_3$ is connected to one end of rheostat $R_{H1}$, the other end of which is connected to one end of light sensor LS. The emitter of transistor $Q_3$ is also connected to a junction point between resistors $R_{2b}$ and $R_{2c}$. This junction point is also connected to the base of NPN transistor $Q_2$. The collector of transistor $Q_2$ is connected through resistor $R_{2a}$ to the other end of capacitor C. The emitter of transistor $Q_2$ is connected to that end of resistor $R_{2c}$ remote from the junction point between resistors $R_{2b}$ and $R_{2c}$. The col of transistor $Q_2$ is also connected to the base of PNP transistor $Q_1$ whose emitter and collector are connected across terminal 113 and 114 of the dimming controller of application Ser. No. 358,257.

In operation, transistors $Q_1$, $Q_2$ and $Q_3$ are provided power for operation from the dimming controller associated with the fluorescent lamp or lamps connected to ballast 31. As can be seen no auxiliary power supply such as 21 (FIG. 1) is required with the circuitry of FIG. 2. Rheostat $R_{h1}$ acts as a threshold control. Transistor $Q_3$ is the photo-amplifier such as 13 of FIG. 1. Transistor $Q_2$ operates both as the equivalent of regulation amplifier 15 of FIG. 1 and as a partial current sink. Transistor $Q_1$ is the main current sink of the invention. The invention relies upon the fact that ballast 31 provides enough operating voltage across, and operating current to, terminals 113 and 114 to operate transistors $Q_1$, $Q_2$ and and $Q_3$.

It should be apparent that various modifications of the above will be evident to those skilled in the art and that the arrangement described herein is for illustrative purposes and is not to be considered restrictive.

What is claimed is:

1. A control circuit for a fluorescent lamp dimmer connected to a ballast for said fluorescent lamp, said dimmer having two control terminals, said control circuit including a light sensor which produces an output signal representative of ambient light, a first amplifier, said light sensor being connected to said first amplifier which amplifies the output signal of said light sensor said first amplifier having an output, a second amplifier connected to the output of said first amplifier, said second amplifier operating to regulate the output signal of said first amplifier, said second amplifier having an output, and a third stage acting as a current sink connected to the output of said second amplifier and across said two control terminals, said control circuit receiving operating power for its entire operating cycle through said control terminals from said dimmer.

2. A control circuit for a dimmer as claimed in claim 1, wherein said second amplifier also acts as a current sink.

3. A control circuit for a dimmer as claimed in claim 2, wherein said first amplifier is an NPN transistor.

4. A control circuit for a dimmer as claimed in claim 3, wherein said second amplifier is an NPN transistor.

5. A control circuit for a dimmer as claimed in claim 4, wherein said third stage is an PNP transistor.

* * * * *